US007756459B2

(12) United States Patent
Ohno

(10) Patent No.: US 7,756,459 B2
(45) Date of Patent: Jul. 13, 2010

(54) FIXING DEVICE

(75) Inventor: Yasuhiro Ohno, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 277 days.

(21) Appl. No.: 11/668,847

(22) Filed: Jan. 30, 2007

(65) Prior Publication Data

US 2008/0019742 A1 Jan. 24, 2008

(30) Foreign Application Priority Data

Feb. 27, 2006 (JP) ..... 2006-050104

(51) Int. Cl.
*G03G 15/20* (2006.01)

(52) U.S. Cl. ..... 399/328

(58) Field of Classification Search ..... 399/122, 399/328

See application file for complete search history.

(56) References Cited

U.S. PATENT DOCUMENTS 6,819,904 B2 11/2004 Terada et al.
6,872,925 B2 * 3/2005 Asakura et al. ..... 219/619
7,129,448 B2 10/2006 Matsunaga et al.
2005/0173415 A1 8/2005 Yamamoto et al.

FOREIGN PATENT DOCUMENTS

| | | |
|---|---|---|
| JP | 2000-181258 A | 6/2000 |
| JP | 3426229 C | 5/2003 |
| JP | 3519401 C | 2/2004 |
| JP | 2004-86205 | 3/2004 |
| JP | 2004-341164 | 12/2004 |
| JP | 2005-208623 | 8/2005 |
| JP | 2005-267950 | 9/2005 |

OTHER PUBLICATIONS

An Office Action issued in corresponding Japanese Patent Application No. 2006-050104, mailed Apr. 15, 2008, and translation thereof.

* cited by examiner

*Primary Examiner*—David M Gray
*Assistant Examiner*—Andrew V Do
(74) *Attorney, Agent, or Firm*—Buchanan Ingersoll & Rooney PC

(57) ABSTRACT

In a fixing device, a magnetic flux generated by a coil passes through a magnetic circuit made of a heat generating layer of a fixing member and a magnetic substance core. The magnetic substance core includes a plurality of main cores each having an elongated form along a circumferential direction of the fixing member and arrayed at intervals along a width direction of a sheet. The end row main cores have a second shape effectively closer to an outer peripheral face of the fixing member compared to a first shape possessed by the central row main cores so as to enhance density of the magnetic flux, which passes the magnetic circuit, more in end sections than in a central section with respect to width direction of the sheet.

7 Claims, 9 Drawing Sheets

FIXING DEVICE

This application is based on an application No. 2006-050104 filed in Japan, the contents of which are hereby incorporated by reference.

BACKGROUND OF THE INVENTION

The present invention relates to a fixing device, and more particularly relates to a fixing device of electromagnetic induction heating method. This kind of fixing device is used, for example, as a component of an image forming apparatus such as electrophotographic copiers, printers and facsimiles.

As fixing devices of this kind, as shown in JP 3426229 C, JP 3519401 C and JP 2000-181258 A, there has been known a fixing device having a fixing roller and a pressure roller which are in pressure contact with each other in such a way as to form a nip section for heating a magnetic material layer (such as alloy layers of iron, chrome and nickel; hereinbelow referred to as "heat generating layer") of the fixing roller by electromagnetic induction, transporting recording paper with a toner image attached thereto through the nip section, and melting and fixing the toner image on the recording paper by heat generation in the fixing roller. In order to enhance a temperature rise characteristic by reducing thermal capacity, the heat generating layer of the fixing roller is set to have a thickness as small as, for example, about 100 μm.

SUMMARY OF THE INVENTION

However, the reduction in thermal capacity of the fixing roller causes heat discharge from axial end sections of the fixing roller to the outside, and this increases temperature fall in the end sections compared to an axial central section. Consequently, sections of a recording paper sheet which passed the axial end sections of the fixing roller (across-the-width end sections of the sheet) suffer lowered glossiness and lowered peel strength, which causes a problem of adverse influence on image quality.

An object of the present invention is to provide a fixing device of electromagnetic induction method having a fixing member and a pressing member which are in pressure contact with each other in such a way as to form a nip section to pass sheets for heating the fixing member by electromagnetic induction, the fixing device being capable of maintaining temperature distribution of the fixing member uniform with respect to a width direction of the sheets passing the nip section.

In order to accomplish the object, a fixing device in this invention comprises:

a fixing member having an outer peripheral face with which a sheet to be transported is brought into pressure contact;

a coil placed along the outer peripheral face of the fixing member and made of a conductor coiled to form an elongated shape with respect to a width direction of the sheet to be transported for induction heating of a heat generating layer of the fixing member; and a magnetic substance core placed in such a way as to cover the coil at a position opposite to the fixing member with respect to the coil, wherein a magnetic flux generated by the coil passes a magnetic circuit made of the heat generating layer of the fixing member and the magnetic substance core, the magnetic substance core includes a plurality of main cores each having an elongated form along a circumferential direction of the fixing member and arrayed at intervals along the width direction of the sheet, a plurality of main cores are divided into central row main cores placed in a central section with respect to the width direction of the sheet and end row main cores placed in end sections with respect to the width direction of the sheet, and the end row main cores have a second shape effectively closer to the outer peripheral face of the fixing member compared to a first shape possessed by the central row main cores so as to enhance density of the magnetic flux, which passes the magnetic circuit, more in the end sections than in the central section with respect to the width direction of the sheet.

In the fixing device in the present invention, the end row main cores having the second shape are effectively closer to the outer peripheral face of the fixing member so as to enhance density of a magnetic flux, which passes the magnetic circuit, more in the end sections than in the central section with respect to the width direction of the sheet compared to the central row main cores having the first shape. As a result, the density of a magnetic flux passing the magnetic circuit is enhanced more in the end sections than in the central section with respect to the width direction of the sheet, and this increases heat generation in the fixing member. Therefore, temperature fall due to heat discharge from the end sections of the fixing member with respect to the width direction of the sheet to the outside is offset, which allows the temperature distribution of the fixing member to be maintained uniform.

Longitudinal end sections of the central row main cores and longitudinal end sections of the end row main cores should preferably be placed at an equal distance from the outer peripheral face of the fixing member. In this case, it becomes easy to support a plurality of main cores by holders existing along the width direction of the sheet.

It is preferable to provide a pressure roller which forms a nip section upon coming into pressure contact with the outer peripheral face of the fixing roller. In this case, it becomes possible to smoothly transport sheets through the nip section and to enhance quality of images to be fixed.

In the fixing device in one embodiment, wherein the first shape possessed by the central row main cores is a mountain shape composed of a central section having a certain curvature and linear sections connected to both ends of the central sections, and the second shape possessed by the end row main cores is a circular arc shape having a curvature smaller than that of the central section in the central row main cores.

In the fixing device in one embodiment, wherein the second shape possessed by the end row main cores is a mountain shape composed of a central section having a certain curvature and linear sections connected to both ends of the central sections, and the first shape possessed by the central row main cores is a trapezoidal shape composed of a central section flatter than the central section in the end row main cores and linear sections connected to both ends of the central section and having an inclination sharper than the linear sections in the end row main cores.

In the fixing device in one embodiment, wherein the first shape possessed by the central row main cores is a circular arc shape set with a certain prospective angle, and the second shape possessed by the end row main cores is a circular arc shape set with a prospective angle smaller than the prospective angle of the central row main cores.

In the fixing device in one embodiment, wherein the first shape possessed by the central row main cores is a mountain shape composed of a central section having a certain curvature and linear sections connected to both ends of the central sections, and the second shape possessed by the end row main cores is a mountain shape composed of a central section having a curvature smaller than that of the central section in the central row main cores and linear sections connected to both ends of the central section and being shorter than the linear sections in the central row main cores.

In another aspect, there is provided a fixing device in the present invention comprises:

a fixing member having an outer peripheral face with which a sheet to be transported is brought into pressure contact;

a coil placed along the outer peripheral face of the fixing member and made of a conductor coiled to form an elongated shape with respect to a width direction of the sheet to be transported for induction heating of a heat generating layer of the fixing member; and a magnetic substance core placed in such a way as to cover the coil at a position opposite to the fixing member with respect to the coil, wherein a magnetic flux generated by the coil passes a magnetic circuit made of the heat generating layer of the fixing member and the magnetic substance core, wherein the magnetic substance core includes:

a plurality of main cores each having an elongated form along a circumferential direction of the fixing member and arrayed at intervals along the width direction of the sheet; and foot cores provided in longitudinal end sections of main cores, among a plurality of the main cores, which are placed in end sections with respect to the width direction of the sheet, the foot cores protruding from the longitudinal end sections toward the outer peripheral face of the fixing member, and wherein the foot cores are not provided in the longitudinal end sections of main cores, among a plurality of the main cores, which are placed in a central section with respect to the width direction of the sheet.

In the fixing device in the present invention, foot cores having a shape protruding toward the outer peripheral face of the fixing member are provided in the longitudinal end sections of the main cores placed in the end sections with respect to the width direction of the sheet, whereas the foot cores are not provided in the longitudinal end sections of the main cores placed in the central section with respect to the width direction of the sheet. As a result, the density of a magnetic flux passing the magnetic circuit is enhanced more in the end sections than in the central section with respect to the width direction of the sheet, and this increases heat generation in the fixing member. Therefore, temperature fall due to heat discharge from the end sections of the fixing member with respect to the width direction of the sheet to the outside is offset, which allows the temperature distribution of the fixing member to be maintained uniform.

In the fixing device in one embodiment, wherein the foot cores are formed continuously, in the width direction of the sheet, across the longitudinal end sections of the main cores which are placed in each end section with respect to the width direction of the sheet.

In the fixing device in one embodiment, the density of a magnetic flux passing the magnetic circuit is enhanced further more in the end sections than in the central section with respect to the width direction of the sheet, and this further increases heat generation in the fixing member. Therefore, temperature fall due to heat discharge from the end sections of the fixing member with respect to the width direction of the sheet to the outside is offset, which allows the temperature distribution of the fixing member to be maintained more uniform.

In the fixing device in one embodiment, wherein the foot cores are formed continuously to and integrally with corresponding longitudinal end sections of the main cores placed in the end sections with respect to the width direction of the sheet.

In the fixing device in one embodiment, the density of a magnetic flux passing the magnetic circuit is enhanced further more in the end sections than in the central section with respect to the width direction of the sheet, and this further increases heat generation in the fixing member. Therefore, temperature fall due to heat discharge from the end sections of the fixing member with respect to the width direction of the sheet to the outside is offset, which allows the temperature distribution of the fixing member to be maintained more uniform.

In another aspect, there is provided a fixing device in the present invention comprises:

a fixing member having an outer peripheral face with which a sheet to be transported is brought into pressure contact;

a coil placed along the outer peripheral face of the fixing member and made of a conductor coiled to form an elongated shape with respect to a width direction of the sheet to be transported for induction heating of a heat generating layer of the fixing member; and a magnetic substance core placed in such a way as to cover the coil at a position opposite to the fixing member with respect to the coil, wherein a magnetic flux generated by the coil passes a magnetic circuit made of the heat generating layer of the fixing member and the magnetic substance core, wherein the magnetic substance core includes at least:

a plurality of main cores each having an elongated form along a circumferential direction of the fixing member and arrayed at intervals along the width direction of the sheet; and inner cores each provided in a longitudinal central section of main cores, among a plurality of main cores, which are placed in end sections with respect to the width direction of the sheet, the inner cores having a shape protruding from the longitudinal central section toward the outer peripheral face of the fixing member, and wherein the inner cores are not provided in the longitudinal main section of main cores, among a plurality of the main cores, which are placed in a central section with respect to the width direction of the sheet.

In the fixing device in the present invention, inner cores having a shape protruding toward the outer peripheral face of the fixing member are provided in the longitudinal central sections of the main cores placed in the end sections with respect to the width direction of the sheet, whereas the inner cores are not provided in the longitudinal central sections of the main cores placed in the central section with respect to the width direction of the sheet. As a result, the density of a magnetic flux passing the magnetic circuit is enhanced more in the end sections than in the central section with respect to the width direction of the sheet, and this increases heat generation in the fixing member. Therefore, temperature fall due to heat discharge from the end sections of the fixing member with respect to the width direction of the sheet to the outside is offset, which allows the temperature distribution of the fixing member to be maintained uniform.

In the fixing device in one embodiment, wherein the inner cores are formed continuously, in the width direction of the sheet, across the longitudinal central sections of the main cores which are placed in each end section with respect to the width direction of the sheet.

In the fixing device in one embodiment, the density of a magnetic flux passing the magnetic circuit is enhanced further more in the end sections than in the central section with respect to the width direction of the sheet, and this further increases heat generation in the fixing member. Therefore, temperature fall due to heat discharge from the end sections of the fixing member with respect to the width direction of the sheet to the outside is offset, which allows the temperature distribution of the fixing member to be maintained more uniform.

In the fixing device in one embodiment, wherein the inner cores are formed continuously to and integrally with corresponding longitudinal central sections of the main cores placed in the end sections with respect to the width direction of the sheet.

In the fixing device in one embodiment, the density of a magnetic flux passing the magnetic circuit is enhanced further more in the end sections than in the central section with respect to the width direction of the sheet, and this further increases heat generation in the fixing member. Therefore, temperature fall due to heat discharge from the end sections of the fixing member with respect to the width direction of the sheet to the outside is offset, which allows the temperature distribution of the fixing member to be maintained more uniform.

In the fixing device in one embodiment, wherein the inner cores are inserted into a conductor traveling back and forth to constituting the coil.

In the fixing device in one embodiment, the density of a magnetic flux passing the magnetic circuit is enhanced further more in the end sections than in the central section with respect to the width direction of the sheet, and this further increases heat generation in the fixing member. Therefore, temperature fall due to heat discharge from the end sections of the fixing member with respect to the width direction of the sheet to the outside is offset, which allows the temperature distribution of the fixing member to be maintained more uniform.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The invention will hereinbelow be described in detail in conjunction with the embodiments with reference to the accompanying drawings.

Figure 1:
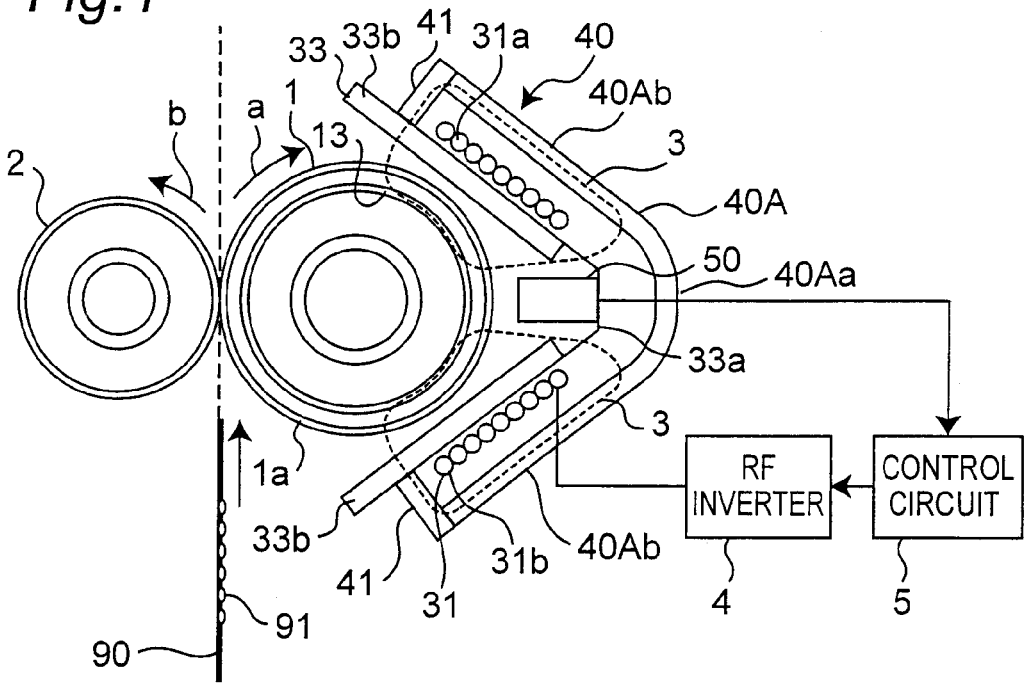
FIG. 1 is a cross sectional view showing a fixing device in one embodiment of the present invention.
Figure 3:
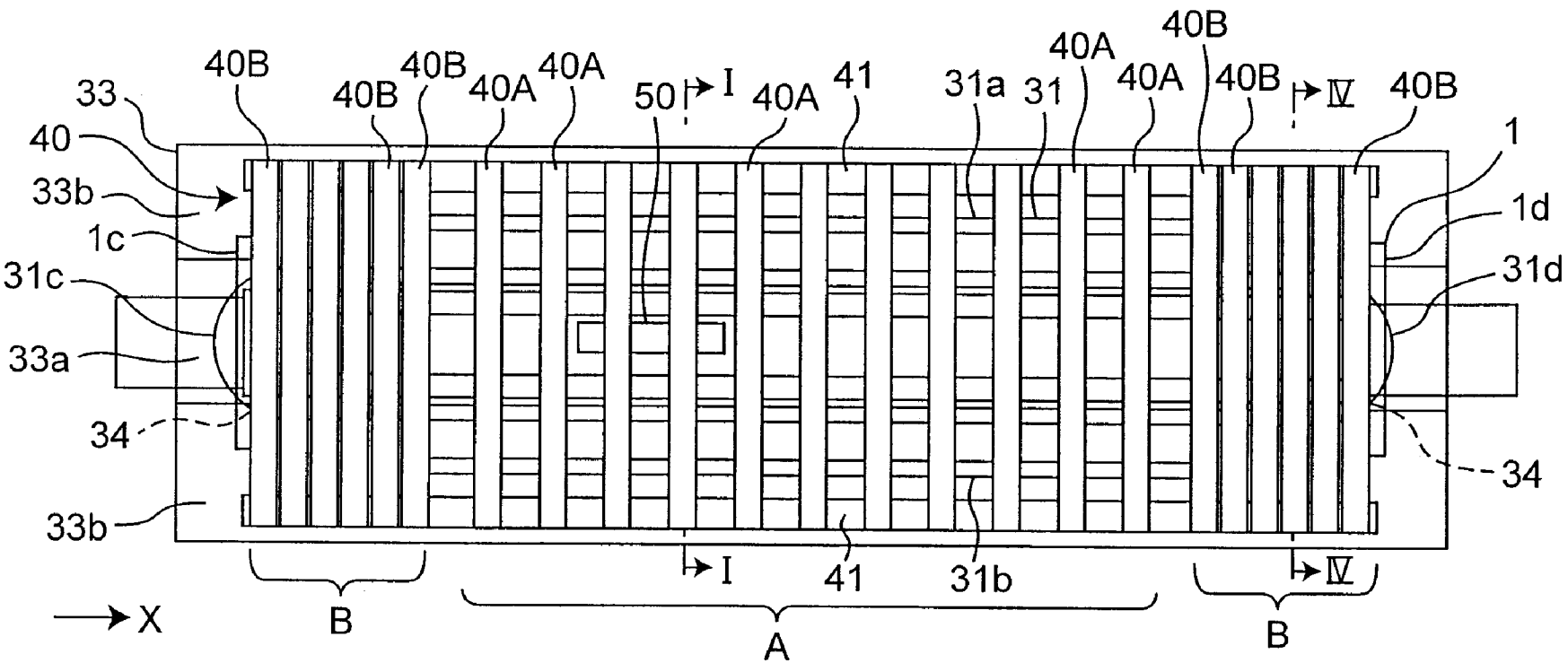
FIG. 3 is a view showing the fixing device of FIG. 1, as viewed from the right-hand side.
Figure 4:
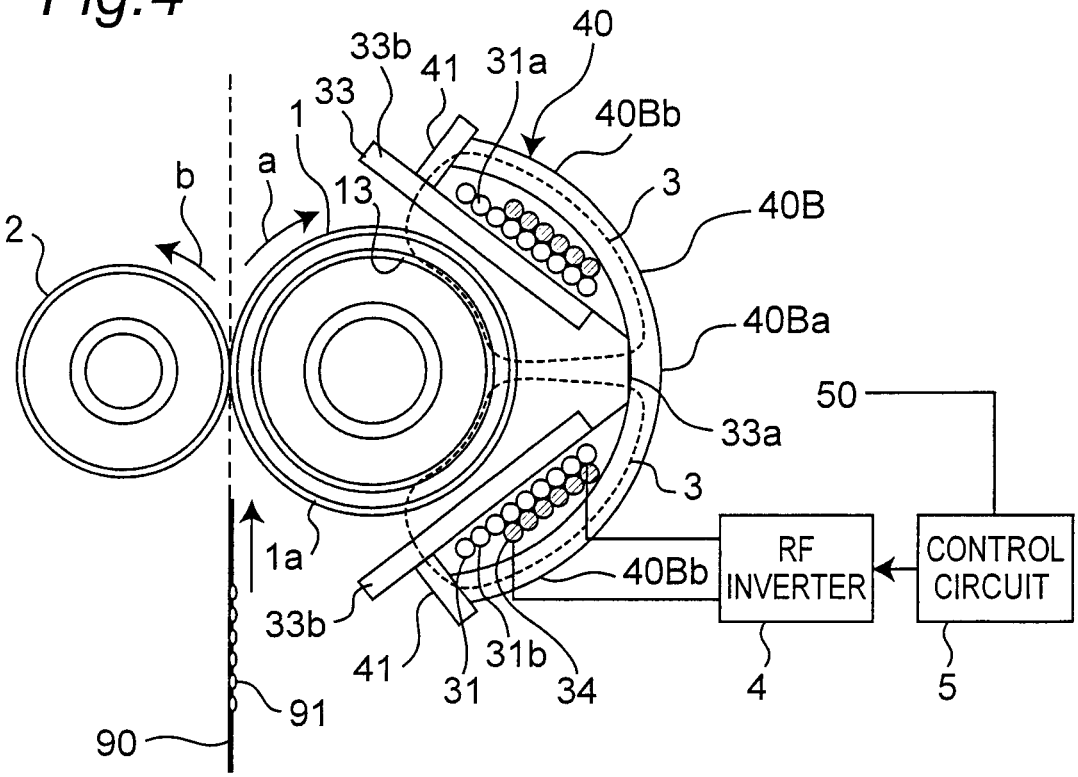
FIG. 4 is another cross sectional view showing the fixing device.

FIG. 1 shows a cross sectional structure of a fixing device of electromagnetic induction heating method in one embodiment, and FIG. 3 shows the fixing device of FIG. 1, as viewed from the right-hand side (FIG. 1 is equivalent to a cross sectional view taken along an arrow line I-I in FIG. 3). FIG. 4 is a cross sectional view taken along an arrow line IV-IV in FIG. 3. This kind of fixing device is suitable for use in color laser printers and the like.

As shown in FIG. 1, the fixing device is mainly composed of a fixing roller 1 serving as a fixing member, a pressure roller 2 serving as a pressing member, a coil bobbin 33 serving as a holder, an exciting coil 31, a magnetic substance core 40, an RF inverter 4 and a control circuit 5. Reference numeral 50 denotes a temperature sensor and reference numeral 90 denotes a paper sheet as a sheet.

The fixing roller 1 and the pressure roller 2, which are cylindrical members extending vertically with respect to the page of FIG. 1, are disposed parallel to each other in the horizontal direction and both ends of each roller are rotatably supported by an unshown bearing member. The pressure roller 2 is biased toward the fixing roller 1 by an unshown pressing mechanism with use of a spring and the like. Consequently, the left-side portion of the fixing roller 1 and the right-side portion of the pressure roller 2 are brought into pressure contact with specified pressing force (described later) so as to form a nip section. The pressure roller 2 is rotationally driven counterclockwise as shown by an arrow b in the drawing at a specified peripheral velocity by an unshown drive mechanism. The fixing roller 1 is rotated clockwise as shown by an arrow a in the drawing in accordance with the rotation of the pressure roller 2 by friction force attained by friction with the pressure roller 2 in the nip section. It is to be noted that the fixing roller 1 may be rotationally driven and the pressure roller 2 may be rotated in accordance with the rotation of the fixing roller 1.

Figure 2A:
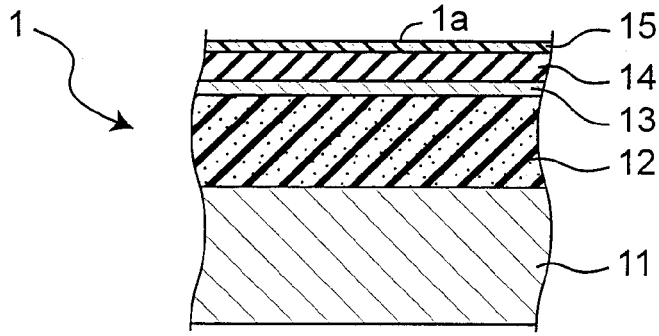
FIG. 2A is a view showing a cross sectional structure of a fixing roller of the fixing device.

As shown in FIG. 2A, the fixing roller 1 has a five-layer structure composed of a mandrel 11 serving as a support layer, a heat insulating layer 12, a heat generating layer 13, an elastic layer 14 and a release layer 15 placed in the order from the central side toward an outer peripheral face 1*a*. The hardness of the fixing roller 1 is, for example, 30 to 90 degrees in Asker-C hardness scale.

The mandrel 11 as a support layer in this example is made of aluminum having a thickness of 3 mm. The material of the mandrel 11 may be a solid roller or a pipe made of metal such as iron and stainless steel or heat-resistant resin such as PPS (polyphenylene sulfide) as long as the strength can be ensured. However, in order to prevent the mandrel 11 from generating heat, nonmagnetic materials which are less affected by electromagnetic induction heating should preferably be used.

The heat insulating layer 12 is provided mainly for putting the generating layer 13 in a heat insulating state. As the material of the heat insulating layer 12, sponges (heat insulating structures) made from rubber materials and resin materials having heat resistance and elasticity are used. Accordingly, the heat insulating layer 12 plays not only a heat insulating role, but also a role to increase a nip width by allowing deflection of the heat generating layer 13 and to enhance sheet discharge performance and sheet separating performance by decreasing the hardness of the fixing roller 1. In the case where the heat insulating layer 12 is made of a silicon sponge material for example, its thickness is set at 2 mm to 10 mm, preferably 3 mm to 7 mmm and its hardness is set at 20 to 60 degrees, preferably 30 to 50 degrees according to an Asker rubber hardness meter. It is to be noted that the heat insulating layer 12 may have a two-layer structure composed of a solid rubber layer as a lower layer and a sponge rubber layer body as an upper layer for enhancing durability. Such a two-layer structure can effectively prevent fracture of rubber particularly in the case where the fixing device is used under relatively hard conditions such as high loads and high speed rotation, the case where the thickness of the heat insulating layer is set to be larger for securing the nip width, and in the case where a soft sponge layer is used.

The heat generating layer 13 is provided to generate heat through electromagnetic induction by a magnetic flux from the exciting coil 31. In this example, the heat generating layer 13 is constituted of an endless electroformed nickel belt layer with a thickness of 40 μm. The thickness of the heat generating layer 13 should preferably be 10 μm to 100 μm and more preferably be 20 μm to 50 μm. The reason why the thickness of the heat generating layer 13 should preferably be 100 μm or less and more preferably be 50 μm or less is to decrease the thermal capacity of the heat generating layer 13 to increase its temperature rise rate. The heat generating layer 13 may be made of materials having a relatively high magnetic permeability μ and an appropriate resistivity ρ such as magnetic materials (magnetic metals) including magnetic stainless steels. Even nonmagnetic materials, if having conductivity such as metals, may be used as the material of the heat generating layer 13 by forming them into thin films. It is to be noted that the heat generating layer 13 may be structured such that particles which generate heat by electromagnetic induction are dispersed over resin. This structure makes it possible to enhance the separating performance.

The elastic layer 14 is provided to promote adhesion (which is important to support color images) between a paper sheet and the surface of the fixing roller by elasticity in the thickness direction. In this example, the elastic layer 14 is made of a rubber material or a resin material having heat resistance and elasticity, and more specifically, made of a heat-resistant elastomer such as silicon rubber and fluorocarbon rubber which can withstand use at fixing temperatures. It is possible to mix various fillers into the elastic layer 14 for the purpose of enhancing thermal conductivity, reinforcement or the like. While examples of thermally conductive particles used as fillers include diamond, silver, copper, aluminum, marble and glass, practical examples thereof include silica, alumina, magnesium oxide, boron nitride and beryllium oxide.

The thickness of the elastic layer 14 should preferably be, for example, 10 μm to 800 μm and more preferably be 100 μm to 300 μm. If the thickness of the elastic layer 14 is less than 10 μm, it is difficult to attain targeted elasticity in the thickness direction. If the thickness exceeds 800 μm, heat generated in the heat generating layer cannot easily reach the outer peripheral face of a fixing film, which causes a tendency for the thermal efficiency to deteriorate.

In the case where the elastic layer 14 is made of silicon rubber, the hardness should be 1 to 80 degrees and preferably 5 to 30 degrees in JIS hardness scale. In this JIS hardness range, it becomes possible to prevent failure in the fixing property of toner while preventing degradation in the strength of the elastic layer and adhesion failure. Specific examples of the silicon rubber include one-component, two-component or three or more-component silicon rubbers, LTV (Low Temperature Vulcanization)-type, RTV (Room Temperature Vulcanization)-type or HTV (High Temperature Vulcanization)-type silicon rubbers, and condensation-type or addition-type silicon rubbers. In this example, as the material of the elastic layer 14, a silicon rubber with a JIS hardness of 10 degree and a thickness of 200 μm is used.

The outermost release layer 15 is provided to enhance the releasing property of the outer peripheral face 1*a*. The material of the release layer 15, which is required to withstand use at fixing temperatures and to have the releasing property for toner, should preferably be made of silicon rubber, fluorocarbon rubber and fluorocarbon resin such as PFA (Tetrafluoroethylene perfluoroalkyl-vinylether copolymer), PTFE (Polytetra fluoroethylene), FEP (Tetra-fluoroethylene hexa-fluoropropylene copolymer) and PFEP (Perfluoroethylene hexa-fluoro-propylene copolymer). The thickness of the release layer 15 should preferably be 5 μm to 100 μm and more preferably be 10 μm to 50 μm. Moreover, adhesion processing with use of primers and the like may be performed in order to enhance interlayer adhesion force. It is to be noted that according to need, the release layer 15 may contain conductive materials, abrasion-resistant materials and good thermal conductive materials as fillers.

Figure 2B:
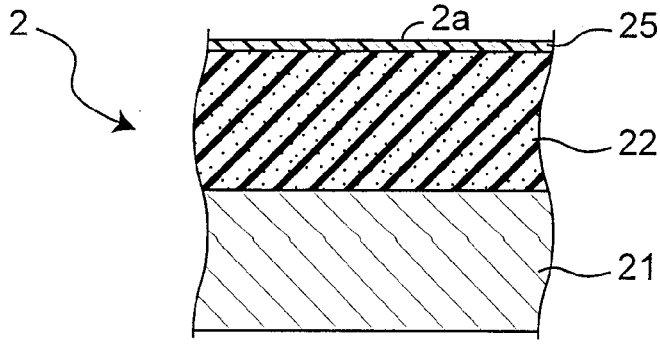
FIG. 2B is a view showing a cross sectional structure of a pressure roller of the fixing device.

As shown in FIG. 2B, the pressure roller 2 has a three-layer structure composed of a mandrel 21 made of aluminum with a thickness of 3 mm, a heat insulating layer 22 made of silicon sponge rubber with a thickness of 3 mm to 10 mm and a release layer 25 made of fluorocarbon resin such as PTFE and PFA with a thickness of 10 to 50 μm placed in the order from the central side toward an outer peripheral face 2*a*.

The material of the mandrel 21 may be a solid roller or a pipe made of metal such as iron and stainless steel or heat-resistant resin such as PPS (polyphenylene sulfide) as long as the strength can be ensured. However, in order to prevent the mandrel 21 from generating heat, nonmagnetic materials which are less affected by electromagnetic induction heating should preferably be used.

The thickness of the heat insulating layer 22 made of silicon sponge rubber may appropriately be changed in the range of 3 mm to 10 mm in accordance with use conditions. While the silicon sponge rubber may be replaced with a solid rubber layer, it is preferable to use materials with low thermal conductivity so as not to release the heat transmitted through the nip section from the fixing roller 1. It is to be noted that the heat insulating layer 22 may have a two-layer structure composed of a solid rubber layer as a lower layer and a sponge rubber layer body as an upper layer for enhancing durability as with the heat insulating layer 12 of the fixing roller 1.

The outermost release layer 25 is provided to enhance the releasing property of the outer peripheral face 2*a*.

The pressure roller 2 is pressed against the fixing roller 1 shown in FIG. 1 with pressing force of 300N to 500N to form a nip section. The nip width in this case is approx. 5 mm to 15 mm. The nip width may be changed by changing a load where necessary.

As shown in FIG. 1, the coil bobbin 33 having a trapezoidal cross section is placed in such a way as to cover the right half of the fixing roller 1. The coil bobbin 33 is composed of inclined sections 33*b*, 33*b* which are vertically symmetric and a connection section 33*a* connecting these inclined sections 33*b*, 33*b*. Moreover, the exciting coil 31 is placed in a layered state along the inclined sections 33*b*, 33*b* of the coil bobbin 33, and the magnetic substance core 40 is placed along the coil bobbin 33 in such a way as to cover the exciting coil 31.

As shown in FIG. 3, the coil bobbin 33 and the exciting coil 31 are long members having a length size roughly corresponding to a size of the fixing roller 1 in its longitudinal direction (axial direction) X (the X direction corresponds to the width direction of a paper sheet 90 shown in FIG. 1).

The coil bobbin 33 is provided to support the exciting coil 31 and the magnetic core 40. The coil bobbin 33 should preferably be made of nonmagnetic materials and in this example is made of heat-resistant resin (e.g., polyimide) with a thickness of 1 mm to 3 mm.

The exciting coil 31 is provided to generate a magnetic flux upon reception of power supply from the RF inverter 4. The exciting coil 31 is formed by winding a conducting wire bundle for a plurality of times to form an oval shape. The conducting wire bundle has an outward section 31*a* and a homeward section 31*b* each extending along the longitudinal direction X of the fixing roller 1 and curved sections 31*c*, 31*d* connecting the outward section 31*a* and the homeward section 31*b* at both ends 1*c*, 1*d* of the fixing roller 1. It is to be noted that a conducting wire bundle is a known stranded wire with a diameter of about several mm formed by bunching about a hundred and several dozen wires (copper wires with a diameter of 0.18 mm to 0.20 mm coated with enamel for insulation) for enhancing conduction efficiency. This makes it possible to receive 100 W to 2000 W electric power with drive frequencies of 10 kHz to 100 kHz from the RF inverter 4. It is to be noted that in this example, the coil coated with heat-resistant resin is used in consideration of heat conducted to the coil.

The magnetic core 40 is provided to increase the efficiency of magnetic circuits and to shield magnetism. In this example, the magnetic core 40 includes a vertical pair of foot cores 41, 41 extending in the X direction and a plurality of main cores 40A, 40B arrayed across these foot cores 41, 41 and at intervals along the X direction.

The foot cores 41, 41, which have a length almost equal to the axial size of the fixing roller 1, are placed along the fixing roller 1. The foot cores 41, 41 are bonded to the inclined sections 33*b*, 33*b* of the coil bobbin 33 via an adhesive agent and are placed, together with the longitudinal end sections of the respective main cores 40A, 40B, at equal distances from the outer peripheral face 1*a* of the fixing roller 1 (see FIG. 1). The respective main cores 40A, 40B and their foot cores 41, 41 are bonded via an adhesive agent with a clearance of about 1 mm and are magnetically coupled. It is to be noted that the clearance between the respective main cores and the foot cores is not limited to this value but should be set in an appropriate range which allows magnetic coupling. Moreover, bonding the respective main cores and the foot cores without clearance or forming them in an integral state allow stronger magnetic coupling, and this makes it possible to increase heat generation efficiency in induction heat generation.

Central row main cores 40A which are placed in a central section (a section excluding both the ends) A with respect to the X direction are arrayed at rough intervals along the X direction, while end row main cores 40B which are placed in end sections B with respect to the X direction are arrayed at small intervals along the X direction. Each of the central row main cores 40A and the end row main cores 40B has an elongated shape with an equal width (X directional size) along the circumferential direction of the fixing roller 1.

In this example, the shape of the central row main cores 40A placed in the central section A with respect to the X direction (which is referred to as "first shape") is a mountain shape made up of, as shown in FIG. 1, a central section 40Aa having a certain curvature and linear sections 40Ab, 40Ab each connected to both the ends of the central section 40Aa. The shape of the end row main cores 40B placed in the end sections B with respect to the X direction (which is referred to as "second shape") is a circular arc shape having a curvature smaller than that of the central section 40Aa in the first shape as shown in FIG. 4. Thus, the placement of the main cores are arranged such that the end row main cores 40B are effectively closer to the fixing roller 1 than the central row main cores 40A.

As the material of the magnetic core 40, magnetic materials having high magnetic permeability and low loss are used. Ferrite cores are generally used and in the case of using alloys such as permalloys, the magnetic core 40 may have a laminated structure since an eddy current loss in the core is increased by radio frequencies. Moreover, using resin materials with magnetic powders dispersed therethrough allows free setting of its shape though magnetic permeability becomes relatively low.

In the central section A with respect to the X direction, as shown in FIG. 1, a magnetic flux 3 generated by the exciting coil 31 passes through a magnetic circuit going in a vertically symmetric way from the central section 40Aa of the main cores 40A to the linear sections 40Ab, the foot cores 41 and the heat generating layer 13 of the fixing roller 1 and returning to the central section 40Aa of the main cores 40A. In the end sections B with respect to the X direction, the magnetic flux 3 generated by the exciting coil 31 passes through a magnetic circuit going in a vertically symmetric way from a central section 40Ba of the main cores 40B to end sections 40Bb, the foot cores 41 and the heat generating layer 13 of the fixing roller 1 and returning to the central section 40Ba of the main cores 40B. In both the cases, the direction of the magnetic flux 3 passing the magnetic circuit becomes forward and backward depending on alternate current applied to the exciting coil 31. Consequently, in the central section A and the end sections B with respect to the X direction, an eddy current flows to the heat generating layer 13 of the fixing roller 1 and the heat generating layer 13 itself generates heat (Joule heat). Since the portion immediately below the heat generating layer 13 of the fixing roller 1 is insulated by the heat insulating layer 12 (see FIG. 2), heat generated by the heat generating layer 13 swiftly heats the elastic layer 14 and the release layer 15, and the temperature of the outer peripheral face 1*a* of the fixing roller 1 (this is referred to as "fixing roller surface temperature) rises.

Heating and temperature control of the fixing roller 1 are performed by the control circuit 5. A temperature sensor 50, which is, for example, a noncontact infrared temperature sensor, is placed in such a way as to face the outer peripheral face 1*a* of the fixing roller 1 in close proximity. It is to be noted that as the temperature sensor 50, a contact thermister may be used. A detection signal representing the fixing roller surface temperature from the temperature sensor 50 is inputted into the control circuit 5. The control circuit 5 controls the RF inverter 4 based on the detection signal from the temperature sensor 50 and increases or decreases power supply from the RF inverter 4 to the exciting coil 31 so that the fixing roller surface temperature is maintained at a specified constant temperature. As the temperature sensor 50, in addition to the infrared temperature sensor, a thermostat and others may be used for the purpose of the safety.

During fixing operation, the pressure roller 2 is rotationally driven, and following after this rotation, the fixing roller 1 rotates. At the same time, the heat generating layer 13 of the fixing roller 1 generates heat through electromagnetic induction by a magnetic flux generated by the exciting coil 31, and the surface temperature of the fixing roller 1 is automatically controlled such that a specified constant temperature is maintained. In this state, by an unshown transportation mechanism, the paper sheet 90 as a sheet with an unfixed toner image 91 formed on one face is sent into the nip section formed from the fixing roller 1 and the pressure roller 2. In this case, the face of the paper sheet 90 with the unfixed toner image 91 formed thereon comes into contact with the fixing roller 1. The paper sheet 90 sent into the nip section formed from the fixing roller 1 and the pressure roller 2 is heated by the fixing roller 1 while passing the nip section. As a result, the unfixed toner image 91 is fixed onto the paper sheet 90. The paper sheet 90 after passing the nip section is released from the fixing roller 1 and discharged upward. It is to be noted that the paper sheet 90 may be replaced with an OHP sheet and the like.

Figure 5:
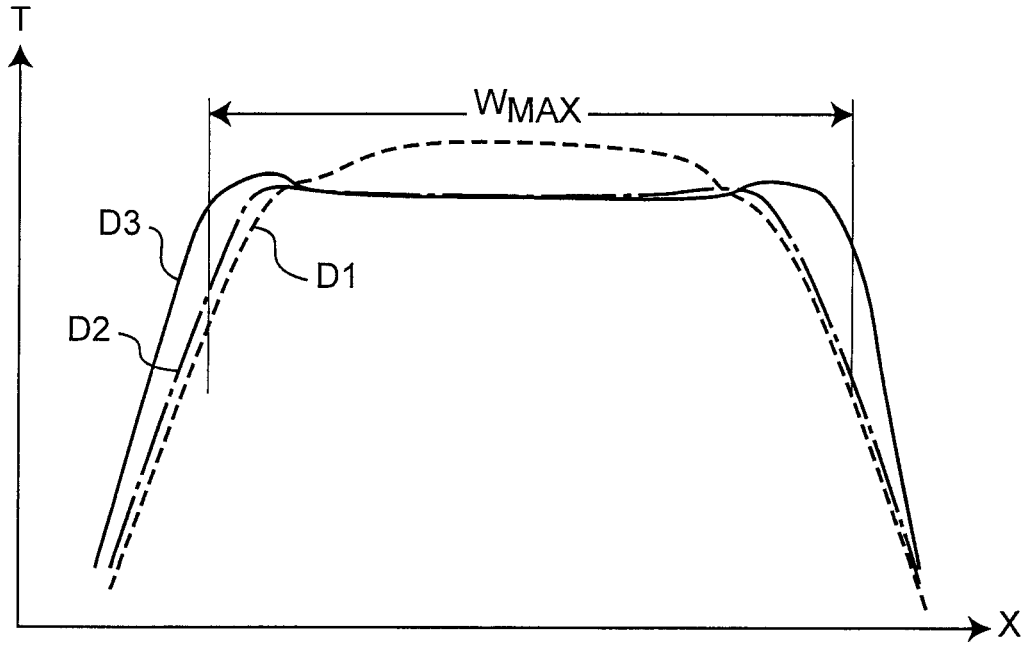
FIG. 5 is a view showing temperature distribution of the fixing roller in the fixing device along the axial direction (X direction)

As stated before in the prior art example, the fixing device of the electromagnetic induction heating method has a tendency that the temperature fall due to heat discharge from the axial (X axial) end sections of the fixing roller 1 to the outside is larger in the end sections B than in the central section A. In FIG. 5, temperature distribution in a prior art example (in which all the main cores are in a mountain shape and are placed at constant intervals with respect to the X direction) is shown with a broken line D1 (FIG. 5 also shows the width of a maximum size paper sheet 90 passing through the nip section (maximum paper passing region) $W_{max}$). In the temperature distribution D1 in the prior art example, it is found that temperature fall (so called "temperature slack") occurs on both the end sections in the maximum paper passing region $W_{max}$.

However, in this embodiment, as stated before, the central row main cores 40A which are placed in the central section (the section excluding both the ends) A with respect to the X direction are arrayed at rough intervals along the X direction, while the end row main cores 40B which are placed in the end sections B with respect to the X direction are arrayed at small intervals along the X direction. In addition, the placement of the main cores are arranged such that the end row main cores 40B are effectively closer to the fixing roller 1 than the central row main cores 40A. As a result, the density of a magnetic flux passing the magnetic circuit is enhanced more in the end sections B than in the central section A with respect to the X direction and this increases heat generation in the fixing roller 1. Therefore, as shown by a solid line D3 in FIG. 5, temperature fall due to heat discharge from the end sections of the fixing roller 1 with respect to the X direction to the outside can be offset, which allows the temperature distribution of the fixing roller 1 to be maintained uniform.

It is to be noted that a chain line D2 in FIG. 5 shows the case of a simple solution in which the main cores are arrayed at rough intervals in the central section (the section excluding both the ends) A with respect to the X direction, while the main cores are arrayed at small intervals in the end sections B with respect to the X direction (i.e., the case in which the main cores are all in a mountain shape). The temperature distribution D2 in this case is rather closer to the temperature distribution D1 in the prior art example than to the temperature distribution D3 in the present embodiment, indicating that the simple solution is not sufficient enough.

As described before, when the central row main cores 40A placed in the central section A with respect to the X direction are formed into a mountain shape, there is an advantage that, as shown in FIG. 1, the temperature sensor 50 as well as unshown wiring cables can easily be placed inside, i.e., in between the fixing roller 1 and the central row main cores 40A. Moreover, such a shape makes it possible to reduce concentration of a magnetic flux to the temperature sensor 50.

Figure 6:
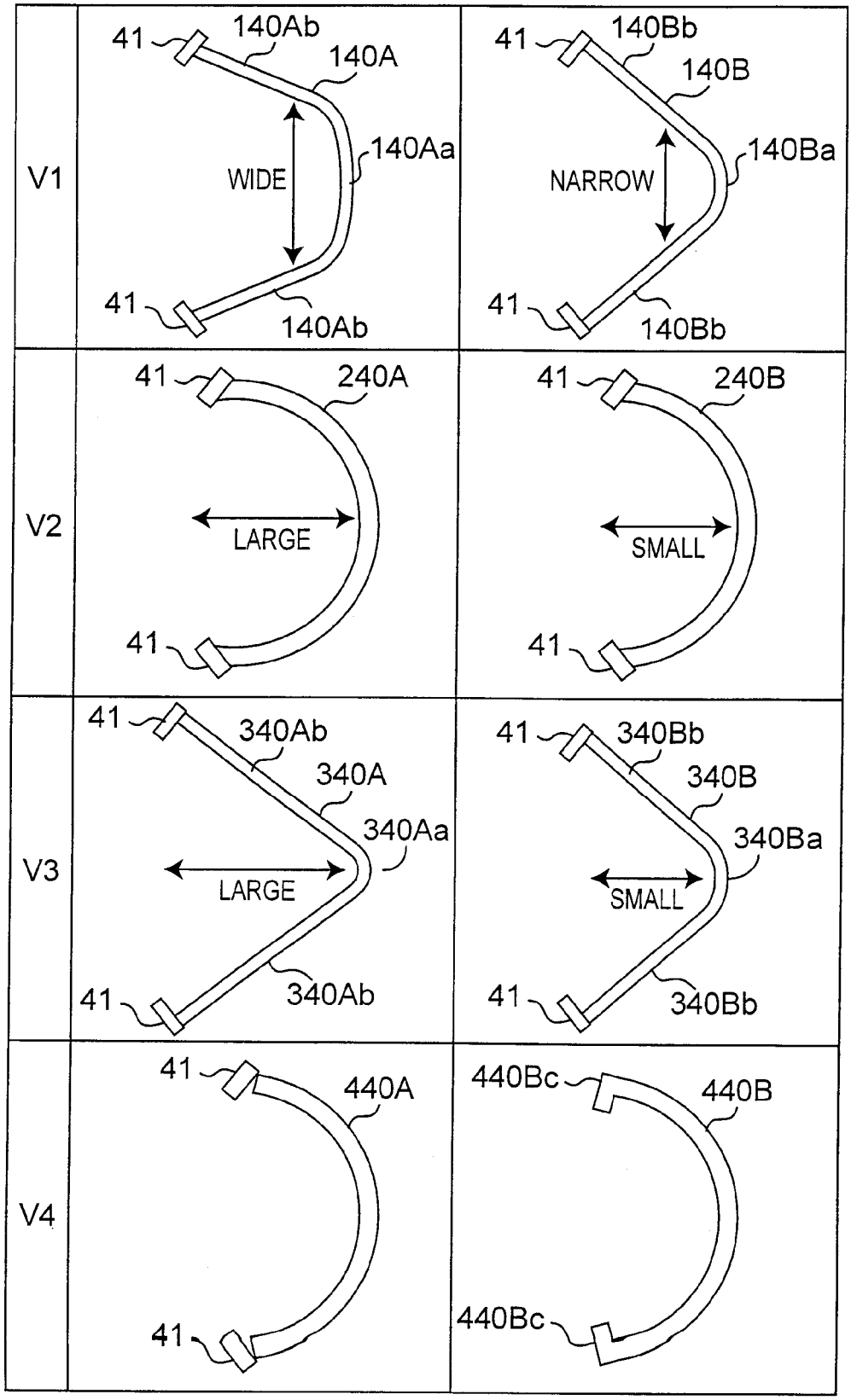
FIG. 6 is a view showing varied combinations of first and second shapes possibly taken by central row main cores and end row main cores in the fixing device.

FIG. 6 shows varied combinations of first and second shapes possibly taken by the central row main cores and the end row main cores (combinations other than the stated mountain shape and circular arc shape).

In a first example V1 in FIG. 6, the second shape possessed by end row main cores 140B is a mountain shape composed of a central section 140Ba having a certain curvature and linear sections 140Bb, 140Bb connected to both ends of the central section 140Ba, whereas the first shape possessed by the central row main cores 140A is a trapezoidal shape composed of a central section 140Aa flatter than the central section 140Ba in the end row main cores 140B and linear sections 140Ab, 140Ab connected to both ends of the central section 140Aa and having an inclination sharper than the linear sections 140Bb, 140Bb in the end row main cores 140B. In this case, the inner space of the central row main cores 140A is large whereas the inner space of the end row main cores 140B is small, as a consequence of which the end row main cores 140B are effectively closer to the outer peripheral face of the fixing roller 1 than the central row main cores 140A.

In a second example V2, the first shape possessed by central row main cores 240A is a circular arc shape set with a certain prospective angle (180° or more in this example), whereas the second shape possessed by end row main cores 240B is a circular arc shape set with a prospective angle (about 180° in this example) smaller than the prospective angle of the central row main cores 240A. In this example, the end row main cores 240B are effectively closer to the outer peripheral face of the fixing roller 1 than the central row main cores 240A.

In a third example V3, the first shape possessed by central row main cores 340A is a mountain shape composed of central section 340Aa having a certain curvature and linear sections 340Ab, 340Ab connected to both ends of the central section 340Aa, whereas the second shape possessed by the end row main cores 340B is a mountain shape composed of a central section 340Ba having a curvature smaller than that of the central section 340Aa in the central row main cores 340A and linear sections 340Bb, 340Bb connected to both ends of the central section 340Ba and being shorter than the linear sections 340Ab, 340Ab in the central row main cores 340A. In this case, the end row main cores 340B are effectively closer to the outer peripheral face of the fixing roller 1 than the central row main cores 340A.

In these examples V1, V2 and V3, the respective end row main cores are effectively closer to the outer peripheral face of the fixing roller 1 than the central row main cores. As a result, the density of a magnetic flux passing the magnetic circuit is enhanced more in the end sections B than in the central section A with respect to the X direction and this increases heat generation in the fixing roller 1. Therefore, temperature fall due to heat discharge from the end sections of the fixing roller 1 with respect to the X direction to the outside can be offset, which allows the temperature distribution of the fixing roller 1 to be maintained uniform.

In the above examples, the central row main cores and the end row main cores were made different in shape from each other. However, it is also possible from a different point of view to enhance the density of a magnetic flux passing the magnetic circuit more in the end sections B than in the central section A with respect to the X direction. For example, in a fourth example V4 in FIG. 6, end row main cores 440B and foot cores 440Bc, 440Bc are formed continuously and integrally, while central row main cores 440A and a foot core 41 are formed as independent components and bonded to each other via an adhesive agent. In this case, it is still possible to enhance the density of a magnetic flux passing the magnetic circuit more in the end sections B than in the central section A with respect to the X direction. As a result, the density of a magnetic flux passing the magnetic circuit is enhanced more in the end sections B than in the central section A with respect to the X direction and this increases heat generation in the fixing roller 1. Therefore, temperature fall due to heat discharge from the end sections of the fixing roller 1 with respect to the X direction to the outside can be offset, which allows the temperature distribution of the fixing roller 1 to be maintained uniform.

Figure 7:
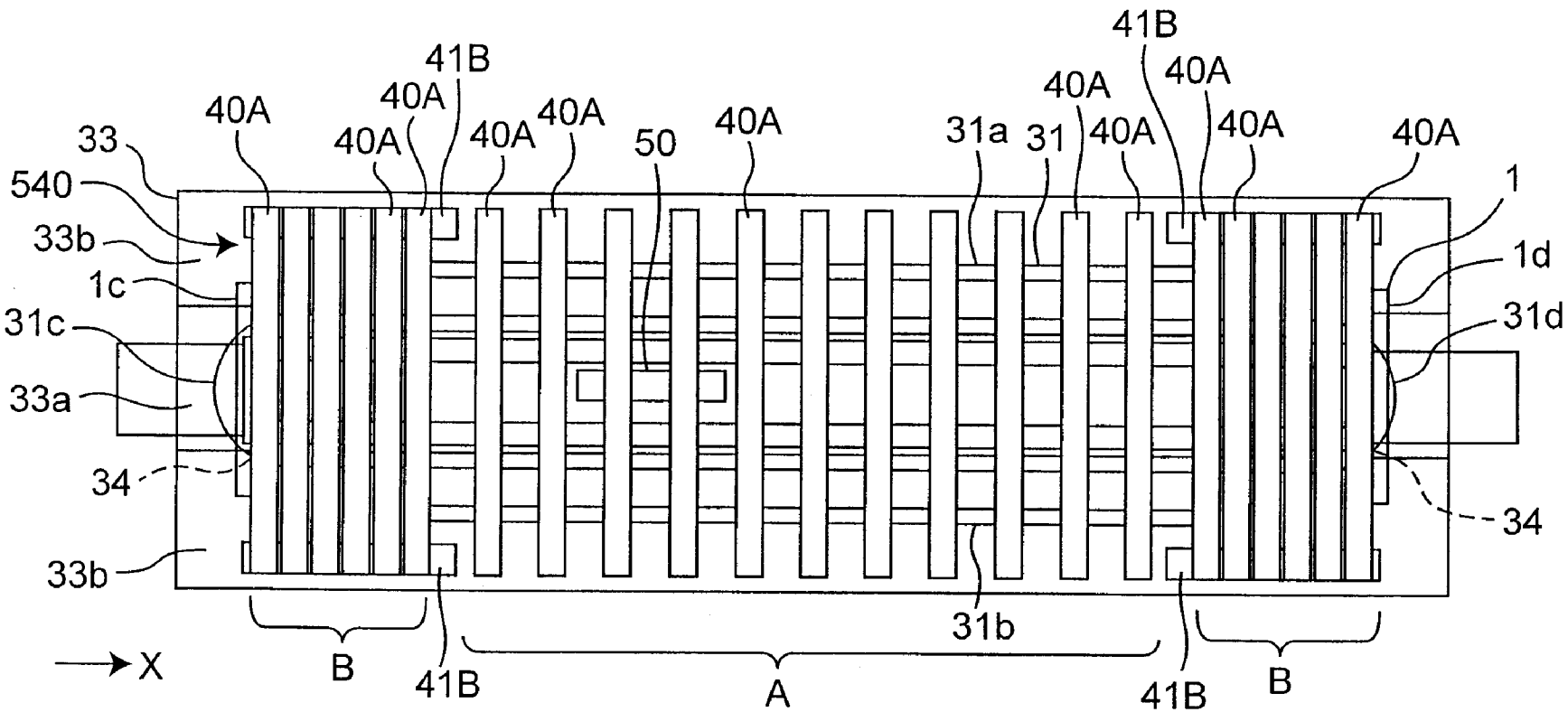
FIG. 7 is a view showing a fixing device in another embodiment of the present invention from the viewpoint similar to that of FIG. 3.

Moreover, FIG. 7 shows the case in which foot cores 41B are provided only in the end sections B with respect to the X direction while the foot cores are omitted in the central section A with respect to the X direction. In this example, all the main cores are of type 40A with a mountain shape.

More specifically, in the aforementioned example as described with reference to FIG. 3, the foot cores 41, 41, which have a length almost equal to the axial size of the fixing roller 1, are placed along the fixing roller 1, whereas in the example in FIG. 7, the respective foot cores 41B are formed continuously across the longitudinal end sections of the main cores 40A placed in each end section B with respect to the X direction but are not present in the central section A with respect to the X direction.

Figure 8:
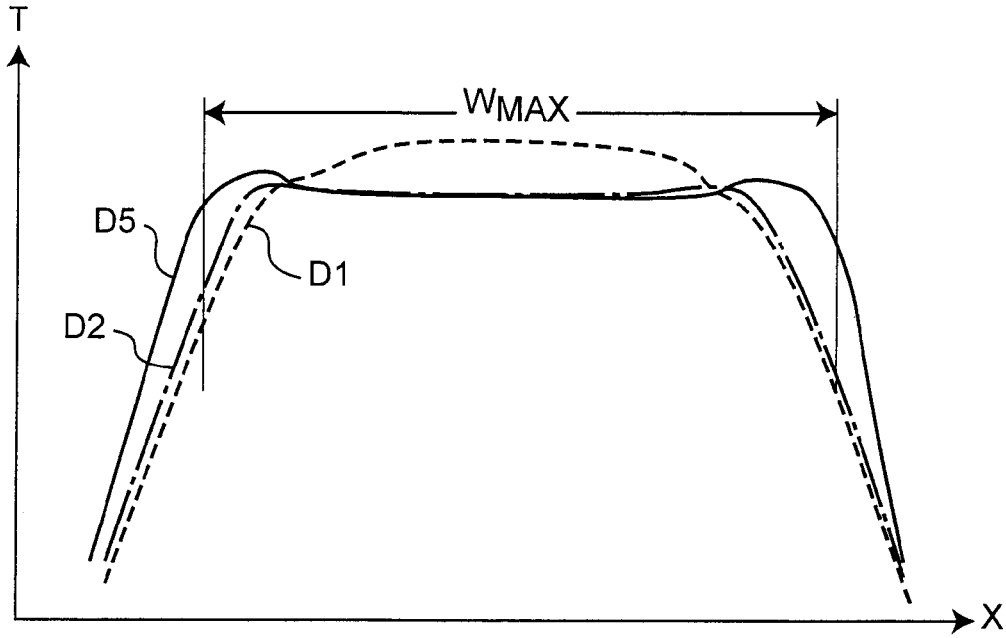
FIG. 8 is a view showing temperature distribution of the fixing roller in the fixing device in FIG. 7 along the axial direction (X direction)

As a result, as shown by a solid line D5 in FIG. 8, the density of a magnetic flux passing the magnetic circuit is enhanced more in the end sections B than in the central section A with respect to the X direction and this increases heat generation in the fixing roller 1. Therefore, temperature fall due to heat discharge from the end sections of the fixing roller 1 with respect to the X direction to the outside can be offset, which allows the temperature distribution of the fixing roller 1 to be maintained uniform. It is to be noted that the lines D1, D2 in FIG. 7 are identical to those in FIG. 4.

Also in this example, the density of a magnetic flux passing the magnetic circuit in the end sections B may be further enhanced by forming the longitudinal end sections of the main cores 40A placed in the end sections B with respect to the X direction and the corresponding foot cores 41B continuously and integrally in the same way as being stated in the fourth example V4 in FIG. 6.

Figure 9:
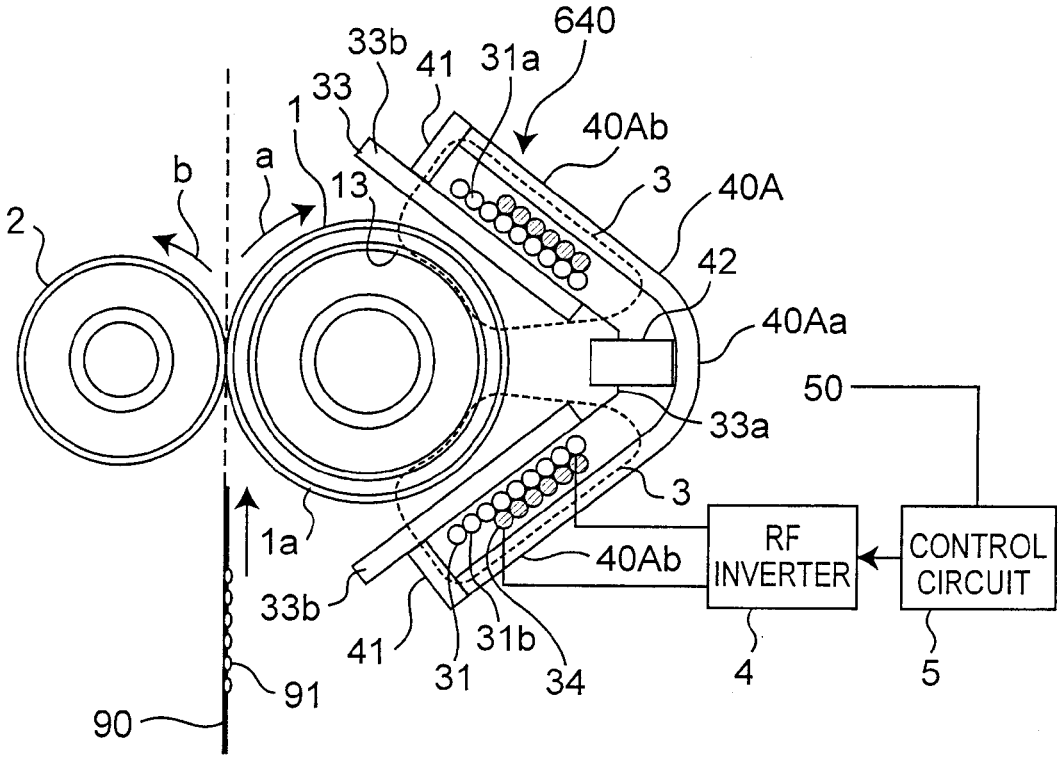
FIG. 9 is a cross sectional view showing a fixing device in still another embodiment of the present invention, which corresponds to FIG. 4.
Figure 10:
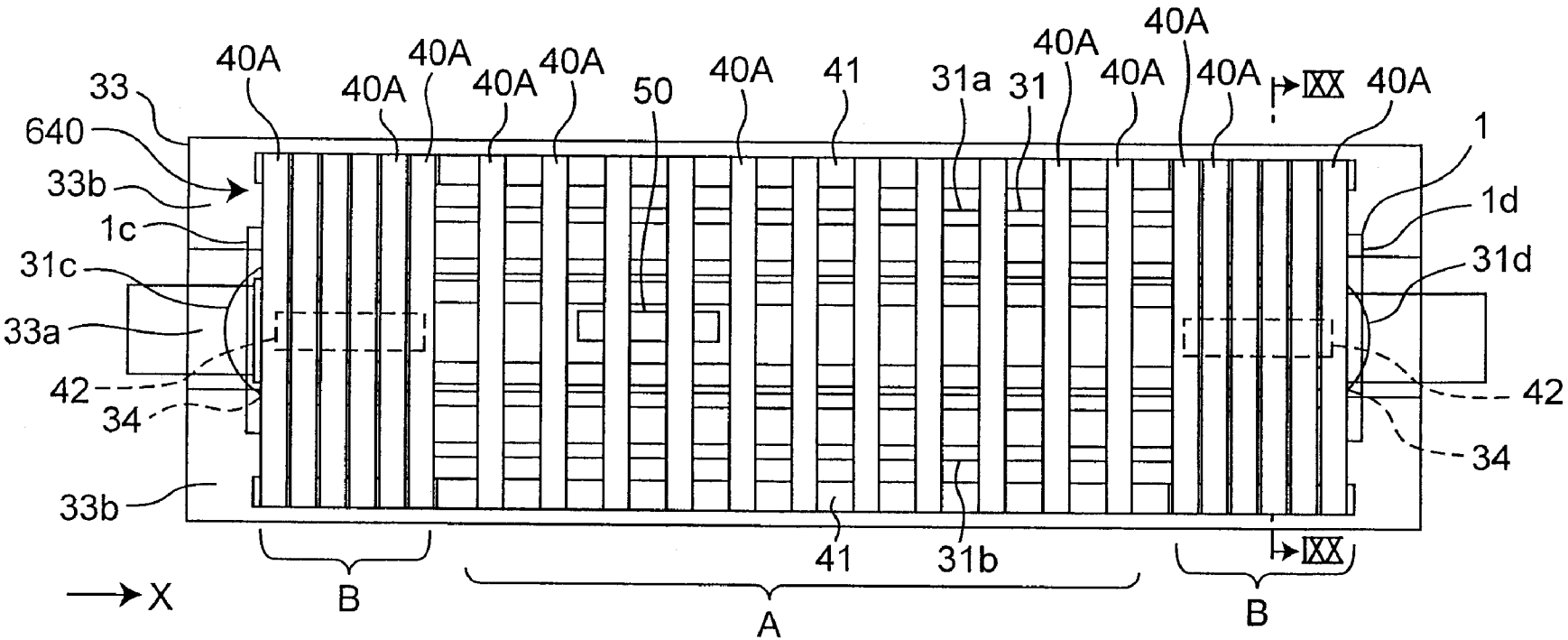
FIG. 10 is a view showing the fixing device of FIG. 9, as viewed from the right-hand side.

Moreover, FIG. 9 and FIG. 10 show an example in which another magnetic substance core 640 is provided, i.e., inner cores 42 are provided only in end sections B with respect to the X direction while the inner cores are omitted in a central section A with respect to the X direction. In this example, all the main cores are of type 40A with a mountain shape. Moreover, foot cores 41, 41, which have a length almost equal to the axial size of the fixing roller 1, are placed along the fixing roller 1.

As shown in FIG. 9 (corresponding to a cross sectional view taken along an arrow line IXX-IXX in FIG. 10), the inner cores 42 are mounted on a central section 40Aa in the main cores 40A placed in end sections B with respect to the X direction via an adhesive agent and have a shape protruding from the central section 40Aa toward the outer peripheral face 1*a* of the fixing roller 1. In the example in FIG. 7, the respective inner cores 42 extend in the X direction in the state formed continuously across the longitudinal end sections of the main cores 40A placed in each end section B with respect to the X direction but the inner cores are not present in the central section A with respect to the X direction.

As a result, the density of a magnetic flux passing the magnetic circuit is enhanced more in the end sections B than in the central section A with respect to the X direction and this increases heat generation in the fixing roller 1. Therefore, temperature fall due to heat discharge from the end sections of the fixing roller 1 with respect to the X direction to the outside can be offset, which allows the temperature distribution of the fixing roller 1 to be maintained more uniform. In addition, the inner cores 42 are inserted in between conductor bundles 31*a*, 31*b* traveling back and forth to constitute the exciting coil 31 (central aperture). Since the central aperture of the exciting coil 31 is a spot on which the magnetic flux particularly tends to concentrate, the effect of the inner cores 42 becomes larger.

Also in this example, the density of a magnetic flux passing the magnetic circuit in the end sections B may be further enhanced by forming the longitudinal end sections of the main cores 40A placed in the end sections B with respect to the X direction and the corresponding inner cores 42 continuously and integrally in the same way as being stated in the fourth example V4 in FIG. 6.

Figure 11:
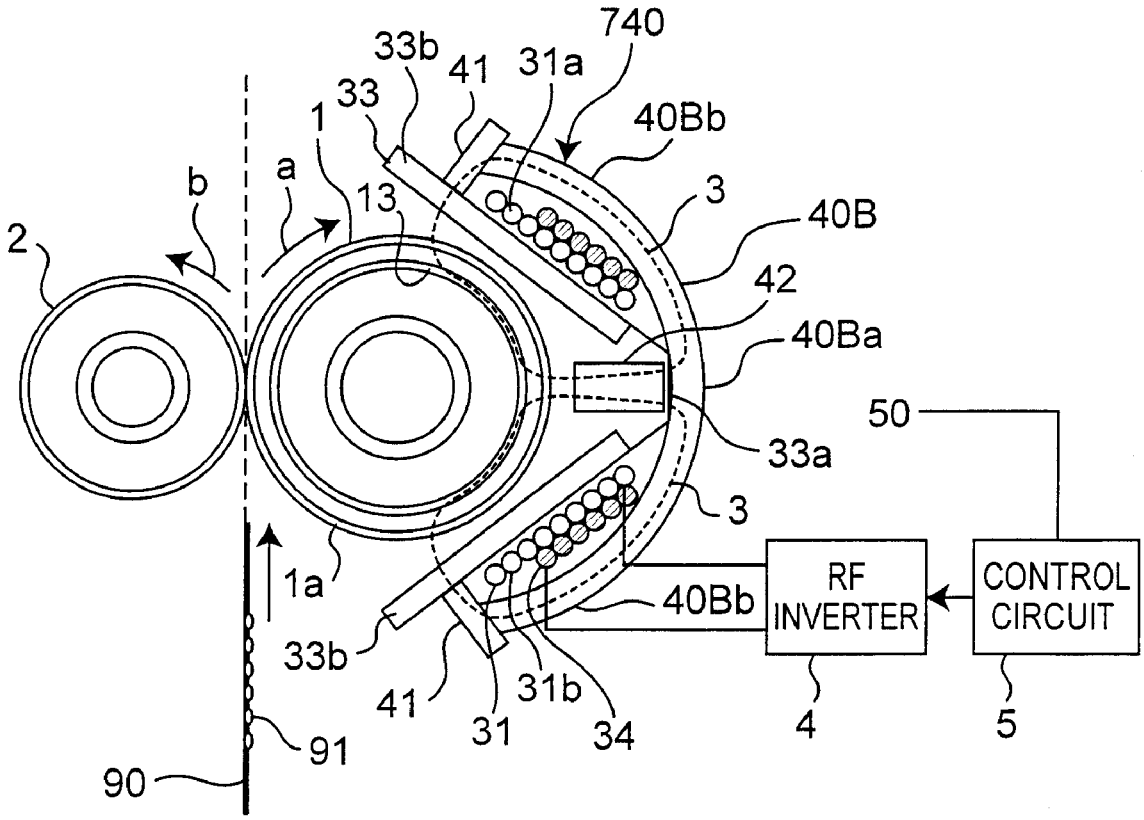
FIG. 11 is a cross sectional view showing a fixing device in yet another embodiment of the present invention, which corresponds to FIG. 4.
Figure 12:
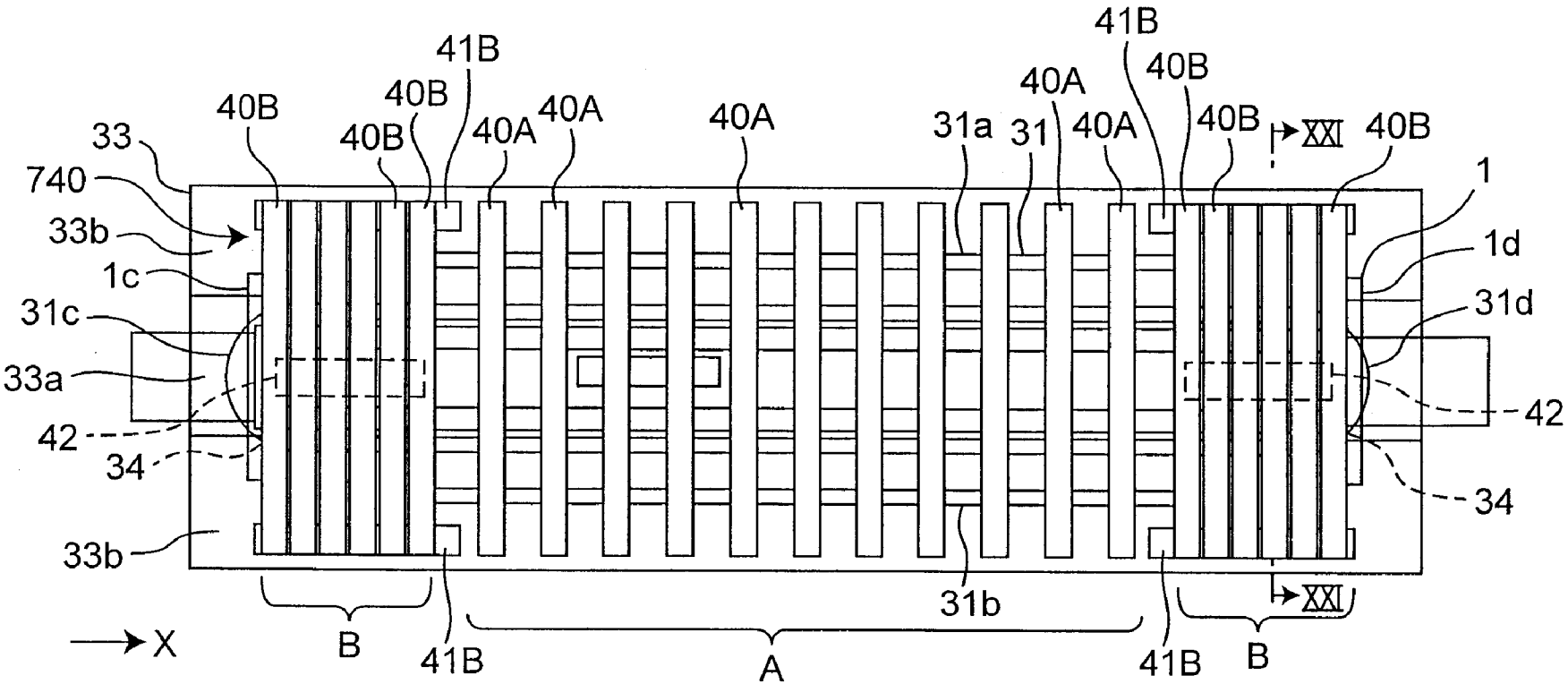
FIG. 12 is a view showing the fixing device of FIG. 11, as viewed from the right-hand side.

Moreover, FIG. 11 and FIG. 12 show an example in which another magnetic substance core 740 is provided, i.e., an example in which the aforementioned solutions to the temperature fall due to heat discharge from the end sections of the fixing roller 1 to the outside are applied in combination (FIG. 11 corresponds to a cross sectional view taken along an arrow line XXI-XXI in FIG. 12). More particularly, in this example, mountain-shaped central row main cores 40A are placed in a central section A with respect to the X direction, while circular arc-shaped end row main cores 40B are placed in end sections B with respect to the X direction. Moreover, foot cores 41B are provided only in the end sections B with respect to the X direction, whereas the foot cores are omitted in the central section A with respect to the X direction. Further, inner cores 42 are provided only in the end sections B with respect to the X direction, whereas the inner cores are omitted in the central section A with respect to the X direction. Thus, applying a plurality of solutions in combination makes it possible to effectively eliminate the temperature fall due to heat discharge from the end sections of the fixing roller 1 to the outside, and this allows the temperature distribution of the fixing roller 1 to be maintained more uniform.

It is naturally understood that also in this example, the foot cores 41B and the inner cores 42 may be formed continuously to and integrally with the end row main cores 40B.

It is to be noted that FIG. 9 and FIG. 11 show that a degaussing coil 34 is overlapped with the exciting coil 31. The degaussing coil 34 is placed in regions (end sections) where the maximum size paper sheet 90 can pass (come into contact) with respect to the X direction but paper sheets with smaller widths (small size paper sheets) cannot pass (cannot come into contact). In the case where fixing is performed on the maximum size paper sheet 90, the degaussing coil 34 is opened and does not function. In the case where fixing is performed on the small size paper sheets, the degaussing coil 34 is closed so as to prevent a magnetic flux from being changed by the exciting coil 31 in the regions where the degaussing coil 34 is placed. This prevents the temperature in the end sections of the fixing roller 1 from increasing compared to the temperature in the central section in the case where fixing is performed on the small size paper sheets.

Although in the embodiments disclosed, the fixing member was the fixing roller 1 and the pressing member was the pressure roller 2, the fixing member and the pressing member are not limited thereto. For example, the fixing member may take a form of an endless fixing belt. The present invention is similarly applied to such a case and achieves similar functions and effects.

It is to be noted that in the case where the magnetic flux generation amount is insufficient while at the same time heat is discharged from the end sections of the fixing member with respect to the width direction of the sheet, the temperature fall in the end sections is sometimes larger than that in the temperature distribution D1 in FIG. 5 and FIG. 8. Particularly, when the axial length of the outward section 31*a* and the homeward section 31*b* in the exciting coil 31 is shorter than the belt width, a magnetic flux generated in the curved sections 31*c*, 31*d* fails to sufficiently contribute to heat generation in the belt, and this causes reduction in heating value. The present invention can cope with such magnetic flux reduction and achieve an effect of downsizing of the soil size.

The invention being thus described, it will be obvious that the same may be varied in many ways. Such variations are not be regarded as a departure from the spirit and scope of the invention, and all such modifications as would be obvious to one skilled in the art are intended to be included within the scope of the following claims.

The invention claimed is:

1. A fixing device, comprising:

a fixing member having an outer peripheral face with which a sheet to be transported is brought into pressure contact;

a coil placed along the outer peripheral face of the fixing member and made of a conductor coiled to form an elongated shape with respect to a width direction of the sheet to be transported for induction heating of a heat generating layer of the fixing member; and a magnetic substance core placed in such a way as to cover the coil at a position opposite to the fixing member with respect to the coil, wherein a magnetic flux generated by the coil passes a magnetic circuit made of the heat generating layer of the fixing member and the magnetic substance core, the magnetic substance core includes a plurality of main cores each having an elongated form along a circumferential direction of the fixing member and arrayed at intervals along the width direction of the sheet, the plurality of main cores are divided into central row main cores placed in a central section with respect to the width direction of the sheet and end row main cores placed in end sections with respect to the width direction of the sheet, and the end row main cores have a second shape effectively closer to the outer peripheral face of the fixing member compared to a first shape possessed by the central row main cores so as to enhance density of the magnetic flux, which passes the magnetic circuit, more in the end sections than in the central section with respect to the width direction of the sheet, wherein intervals between the end row main cores are smaller than intervals between the central row main cores.

2. The fixing device according to claim 1, wherein the second shape possessed by the end row main cores is a mountain shape composed of a central section having a certain curvature and linear sections connected to both ends of the central sections, and the first shape possessed by the central row main cores is a trapezoidal shape composed of a central section flatter than the central section in the end row main cores and linear sections connected to both ends of the central section and having an inclination sharper than the linear sections in the end row main cores.

3. The fixing device according to claim 1, wherein the first shape possessed by the central row main cores is a circular arc shape set with a certain prospective angle, and the second shape possessed by the end row main cores is a circular arc shape set with a prospective angle smaller than the prospective angle of the central row main cores.

4. The fixing device according to claim 1, wherein the first shape possessed by the central row main cores is a mountain shape composed of a central section having a certain curvature and linear sections connected to both ends of the central sections, and the second shape possessed by the end row main cores is a mountain shape composed of a central section having a curvature smaller than that of the central section in the central row main cores and linear sections connected to both ends of the central section and being shorter than the linear sections in the central row main cores.

5. A fixing device, comprising:

a fixing member having an outer peripheral face with which a sheet to be transported is brought into pressure contact;

a coil placed along the outer peripheral face of the fixing member and made of a conductor coiled to form an elongated shape with respect to a width direction of the sheet to be transported for induction heating of a heat generating layer of the fixing member; and a magnetic substance core placed in such a way as to cover the coil at a position opposite to the fixing member with respect to the coil, wherein a magnetic flux generated by the coil passes a magnetic circuit made of the heat generating layer of the fixing member and the magnetic substance core, the magnetic substance core includes a plurality of main cores each having an elongated form along a circumferential direction of the fixing member and arrayed at intervals along the width direction of the sheet, the plurality of main cores are divided into central row main cores placed in a central section with respect to the width direction of the sheet and end row main cores placed in end sections with respect to the width direction of the sheet, and the end row main cores have a second shape effectively closer to the outer peripheral face of the fixing member compared to a first shape possessed by the central row main cores so as to enhance density of the magnetic flux, which passes the magnetic circuit, more in the end sections than in the central section with respect to the width direction of the sheet, wherein the entire second shape and prospective angle possessed by the end row main cores is different from the entire first shape and prospective angle possessed by the central row main cores.

6. The fixing device according to claim 5, wherein the second shape possessed by the end row main cores is a mountain shape composed of a central section having a certain curvature and linear sections connected to both ends of the central sections, and the first shape possessed by the central row main cores is a trapezoidal shape composed of a central section flatter than the central section in the end row main cores and linear sections connected to both ends of the central section and having an inclination sharper than the linear sections in the end row main cores.

7. A fixing device, comprising:

a fixing member having an outer peripheral face with which a sheet to be transported is brought into pressure contact;

a coil placed along the outer peripheral face of the fixing member and made of a conductor coiled to form an elongated shape with respect to a width direction of the sheet to be transported for induction heating of a heat generating layer of the fixing member; and a magnetic substance core placed in such a way as to cover the coil at a position opposite to the fixing member with respect to the coil, wherein a magnetic flux generated by the coil passes a magnetic circuit made of the heat generating layer of the fixing member and the magnetic substance core, the magnetic substance core includes a plurality of main cores each having an elongated form along a circumferential direction of the fixing member and arrayed at intervals along the width direction of the sheet, the plurality of main cores are divided into central row main cores placed in a central section with respect to the width direction of the sheet and end row main cores placed in end sections with respect to the width direction of the sheet, and the end row main cores have a second shape effectively closer to the outer peripheral face of the fixing member compared to a first shape possessed by the central row main cores so as to enhance density of the magnetic flux, which passes the magnetic circuit, more in the end sections than in the central section with respect to the width direction of the sheet, wherein the first shape possessed by the central row main cores is a mountain shape composed of a central section having a certain curvature and linear sections connected to both ends of the central sections, the second shape possessed by the end row main cores is a circular arc shape having a curvature smaller than that of the central section in the central row main cores, and the circular arc shape possessed by the end row main cores arcs along an entirety of the length of the end row main cores along the circumferential direction of the fixing member.

* * * * *